US007131372B2

(12) United States Patent
Lyons

(10) Patent No.: US 7,131,372 B2
(45) Date of Patent: Nov. 7, 2006

(54) MINIATURE FLUID DISPENSING END-EFFECTOR FOR GEOMETRICALLY CONSTRAINED AREAS

(75) Inventor: Richard G. Lyons, Benbrook, TX (US)

(73) Assignee: Lockheed Martin Corporation

( * ) Notice: Subject to any disclaimer, the term of this patent is extended or adjusted under 35 U.S.C. 154(b) by 0 days.

(21) Appl. No.: 10/817,540

(22) Filed: Apr. 2, 2004

(65) Prior Publication Data

US 2005/0115421 A1 Jun. 2, 2005

Related U.S. Application Data

(60) Provisional application No. 60/526,034, filed on Dec. 1, 2003.

(51) Int. Cl.
*B41J 3/407* (2006.01)
*B41J 2/01* (2006.01)

(52) U.S. Cl. ..... 101/42; 347/20; 101/35

(58) Field of Classification Search ..... 101/35; 33/18.1, 21.1, 26, 511; 427/100
See application file for complete search history.

(56) References Cited

U.S. PATENT DOCUMENTS 4,353,677 A * 10/1982 Susnjara et al. ..... 414/735
4,661,681 A * 4/1987 Bannister ..... 219/121.78
4,682,182 A * 7/1987 Oyama et al. ..... 347/106
5,160,939 A * 11/1992 Bajeux et al. ..... 347/78
5,386,762 A * 2/1995 Gokey ..... 99/326
5,572,103 A * 11/1996 Terada ..... 318/568.13
5,645,884 A * 7/1997 Harlow et al. ..... 427/8
6,447,847 B1 * 9/2002 Hynes et al. ..... 427/427.2
6,499,399 B1 * 12/2002 Harenbrock et al. ..... 101/366
6,739,448 B1 * 5/2004 Bevirt et al. ..... 198/750.12
2005/0196484 A1 * 9/2005 Khoshnevis ..... 425/463

FOREIGN PATENT DOCUMENTS

JP 63089352 A * 4/1988
JP 06091946 A * 4/1994
JP 08243455 A * 9/1996
JP 2000238254 A * 9/2000

OTHER PUBLICATIONS

Machine translation of JP 2000-238254 from Japanese Patent Office website.*

* cited by examiner

*Primary Examiner*—Daniel J. Colilla
(74) *Attorney, Agent, or Firm*—Garlich Harrison Markison; Robert McLauchlan

(57) ABSTRACT

An end-effector precisely marks location lines (or dispense fluids) on surfaces as part of an automated part marking system. The automated part marking system that includes a multi-axis gantry robot, a calibration stand, vision or location system(s), and a series of fluid dispensing (inkjet) end-effectors to accomplish the marking task. The end-effector use a pick shaped stylus coupled to a fluid supply and metered by a high-speed pulsed valve to precisely deliver fluids provides within geometrically confined spaces.

23 Claims, 19 Drawing Sheets

When Theta and Δ d are known or postulated
(Neglecting Gravity)

poor quality improved quality

MINIATURE FLUID DISPENSING END-EFFECTOR FOR GEOMETRICALLY CONSTRAINED AREAS

CROSS-REFERENCE TO RELATED APPLICATION

This application claims the benefit of priority to U.S. Provisional Patent Application No. 60/526,034 entitled "Miniature Fluid Dispensing End-Effector for Geometrically Constrained Areas", filed on Dec. 1, 2003, and is incorporated herein by reference in its entirety.

TECHNICAL FIELD OF THE INVENTION

The present invention relates generally to parts marking systems and methods, and more particularly, a system and method for delivering fluids to surfaces in geometrically constrained spaces.

BACKGROUND OF THE INVENTION

Part marking systems address the need to trace components including aircraft, surgical, automotive parts, or other like parts for the duration of their lifetime. These markings can allow parts to be identified and traced to their origin. Additionally these markings can facilitate the assembly of complex structures by providing reference markings or instructions at the assembly point for use in assembling and aligning various parts. To assist in assembly, automated ink jet marking systems often mark locations of hardware and fasteners on part surfaces. This allows the operators to quickly and accurately locate and align sub-assemblies to larger assemblies. Additionally, this avoids the need to construct complicated and expensive jigs to locate sub-assemblies and fasteners.

Current inkjet marking systems provide only horizontal or vertical firing. This adequately addresses the marking of horizontal and vertical surfaces. However, this fails to address the need to appropriately mark components with geometrically confined spaces or surfaces at non-normal angles to the ink jet marking system. Currently, known parts marking systems lack the ability to handle irregular shaped and cylindrical parts having various surface projections such as flanges or stiffeners that are located at non-normal angles to the parts surface. Previously these complex structures were marked by hand or required expensive and unique tooling in order to properly mark attachment locations for the machining of the part.

Additionally, because current inkjet effecters fire only in the horizontal or in the vertical direction, alignment errors may be induced on non-planar surfaces by the angle between the ink stream and the surface normal of the part to be marked. Another problem arises from constraints associated with part geometry depending on the depth and the size of the area to be marked as existing marking heads cannot reach into confined spaces.

FIG. 1 illustrates the problems associated with marking parts or components 10 wherein the surface normal 12 is at a non-zero angle to the ink stream 14 supplied by the marking head. This results in a displacement of the marking from an intended surface 16 to the actual surface 18. Significant alignment errors can be experienced due to an accumulated effect of incorrectly synchronizing system alignments as indicated in the graph provided in FIG. 2. These additive errors include: (1) the alignment of the calibration monument; (2) end effector (tool centerpoint (TCP)); (3) vision or parts location system (vision system centerpoint); (4) part alignment and orientation in space; and (5) work envelope of the robot. Therefore a need exists for a parts marking system capable of accurately marking parts having surfaces located at a non-normal angles to the end-effector or within confined spaces.

SUMMARY OF THE INVENTION

The present invention provides an automated part marking system that substantially eliminates or reduces disadvantages and problems associated with previously developed systems and methods. More specifically, the present invention provides a system and method to very precisely mark location lines (or dispenses fluids) on surfaces such as bulkheads and frames of an aircraft understructure. The lines aid in visually locating smaller parts (such as brackets and clips) relative to the bulkheads. This allows smaller parts to be fastened in the appropriate position without the need for traditional and expensive custom tooling.

One embodiment provides an automated part marking system that includes a 6-axis gantry robot, a calibration stand, vision or location system(s), and a series of fluid dispensing (ink jet) end-effectors to accomplish the marking task. The end-effector provides the ability to access geometrically confined spaces. This ability was not available in previous end-effectors due to limitations imposed by the size of available inkjet heads for the end-effector.

Miniaturization/Optimization of the end-effector's dispensing tip improves the system parameters of part population, system accuracy, and system communication potential. Improving this ability greatly improves the functionality of the part marking system. Furthermore, the dispensing tip provides access into very tight spaces. This end-effector addresses the space limitations identified above and provides access into very tight spaces. This is achieved in part by efficiently packaging components of a dispensing system within a small space.

The stylus/probe of the dispensing tip resembles a dental pick and has an internal orifice with which the fluids are dispensed. The radial clearance provided around the orifice improves the part population candidates of the part marking system.

This end-effector uses a high-speed pulsed valve and orifice within the dispensing tip joined by umbilical tubing to dispense the fluids. Either positive displacement pumps, positive pressure pneumatic reservoir or syringe, or other like delivery systems are used to supply the fluid to the dispensing tip. When compared to traditional systems, this end-effector allows the parts marking system to improve from marking within a Dixie cup, to marking within a thimble.

The dispensing end-effector stylus being much smaller than previously styluses, allows access to tight spaces giving either a best-case radial clearance between the end-effector hardware and part geometry, or a best-case part marking capability when marking adjacent walls and floors. The dispensing end-effector stylus does this while allowing the fluid to remain normal to the intended surface for improved accuracy. Additionally, replaceable items are kept both inexpensive and interchangeable to reduce cost without sacrificing the end-effectors' maintainability or reliability.

The dispensing end-effector stylus improves the accuracy of the parts marking system. This improved accuracy results in increased locations where markings can be applied. This allows engineering datum and location lines to be more accurately drawn for improved alignment of the brackets. Additionally, this dispensing tip provides increased throwing distances for the dispensed fluids, helping to reduce errors and improve accuracy. This improved accuracy results by minimizing potential elevation errors in the intended marks location if the wall is further away than expected.

The dispensing end-effector stylus improves the parts marking systems communication potential. The end-effector allows the system to mark more of the bracket footprint than was previously possible. Doing so minimizes the need for supporting documentation required to assemble components. Additionally, this dispensing tip allows higher viscosity fluids such as inks, paints, epoxy, or adhesives to be dispensed on the surface.

When compared to existing systems, this dispensing tip reduces required daily maintenance, eliminates the need to frequently empty and refill and avoids clogging with better suited fluids that address meniscus formation issues. Fewer clogging issues are present due to a wider selection of fluids available when using positive pressure displacement systems to deliver the fluids. In previous solutions a piezoelectric valve is used to control the fluid's drop velocity, wherein the drop velocity depended on the voltage applied to the valve.

The dispensing end-effector stylus provides an important technical advantage in that its design allows this end-effector to be easily retrofitted on the existing marking system with only minor adjustments.

The parts marking system provided in this disclosure may be used by any manufacturer, which needs to precisely control the delivery of fluid into a geometrically constrained area. Thus, the present invention may be applied to aerospace, automotive, as well as other industries that require the ability to precisely deliver fluid into constrained spaces.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Figure 1:
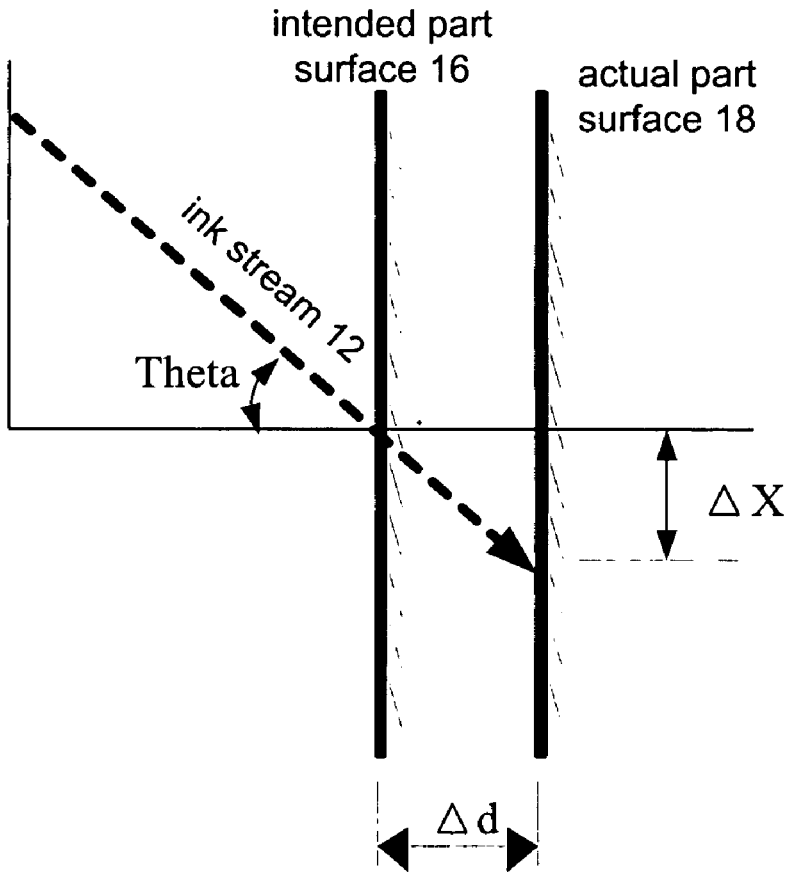
FIG. 1 illustrates problems associated with existing marking heads as applied to parts having confined geometry spaces.

Preferred embodiments of the present invention are illustrated in the FIGUREs, like numerals being used to refer to like and corresponding parts of the various drawings.

An Automated Part Marking System helps reduce costs associated with assembling structural components, such as airframes by producing marks accurate enough for operators to locate parts and drill holes (without tooling). This system helps to ensure that assembly tolerances are repeatably maintained. The Automated Part Marking System helps eliminate tooling development, rework, and maintenance costs. Additionally, the system functionally operates by modularly locating and marking the larger structural components for the eventual location of smaller detail parts. These smaller detail parts are typically brackets used to secure subsystem components, and their installation occurs at varying times (later) in the assembly process.

A Part Marking Robotic Work Cell is employed which in one embodiment has an estimated Work Cell Footprint of approximately 80'×60', with an estimated robot and shuttle footprint of 80'×20', estimated gantry work envelope of 16'×9'×2', and an estimated shuttle table of 14'×6'. The work cell includes a work cell controller, a shuttle transfer mechanism (including two shuttle tables), tooling plates, a six-axis gantry robot, a series of end-effectors, a quick-change end-effector stand, a vision calibration system, and additional ancillary hardware, software, and firmware. The work cell controller integrates automated work cell activities.

The shuttle transfer system acts as a material handling and part docking mechanism for introducing the shuttle tables and parts into the work envelope. Tooling plates accurately and repeatably locate parts on the shuttle tables. The robot moves the marker heads along pre-programmed paths.

The end-effectors allow customized line and text marking with ink-jet heads, and force-sensing probes. The end-effectors are fully functional and integrated with simultaneous axis robot movements. Additionally, the end-effectors support quick-changes during the part marking process and have failsafe collision detection mechanisms designed in.

The vision calibration system helps ensure system accuracy by examining the actual end-effector probe alignment, nozzle rotation, and part mark location against theoretical. This comparison allows compensational adjustments for any variability that exists.

The Automated Part Marking System produces lines and curves on vertical, horizontal, and contoured parts with exceptional precision. These lines will help in visually locating bracket edge positions for assembly. The Automated Part Marking System also produces line-based symbols on vertical, horizontal, and contoured part features with exceptional precision. These symbols may define the position of mounting holes, as well as communicate differences in their attachment procedures. The Automated Part Marking System may also produce legible text on flat surfaces. The text helps identify the parts to be assembled in near-by locations, and provide other types of helpful work instructions.

The end-effectors may use quick-change adaptor that prevents the end-effector from uncoupling from the robot in the event of air, vacuum, power, or other utility loss. Additionally, an integrated force-sensing, or multi-clutch mechanism may detect both moment and in-line axial forces to the probes themselves. This force sensor may include a Tactile Calibration Head integrated from off-the-shelf technology as known to those skilled in the art.

Figure 3:
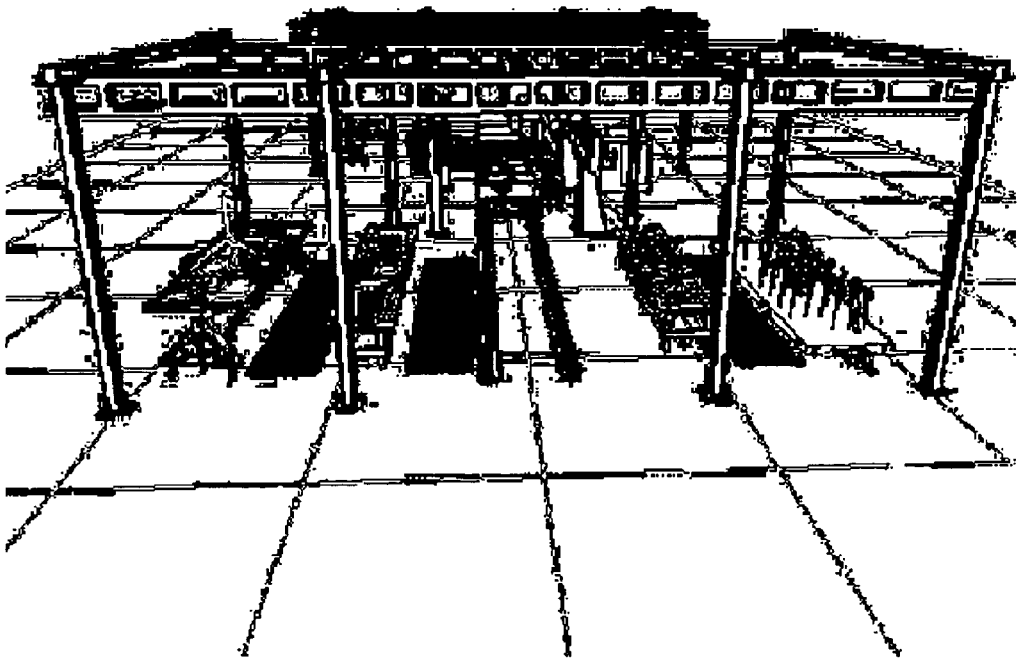
FIG. 3 provides a perspective view of one embodiment of a precision marking system in accordance with the present invention.
Figure 4:
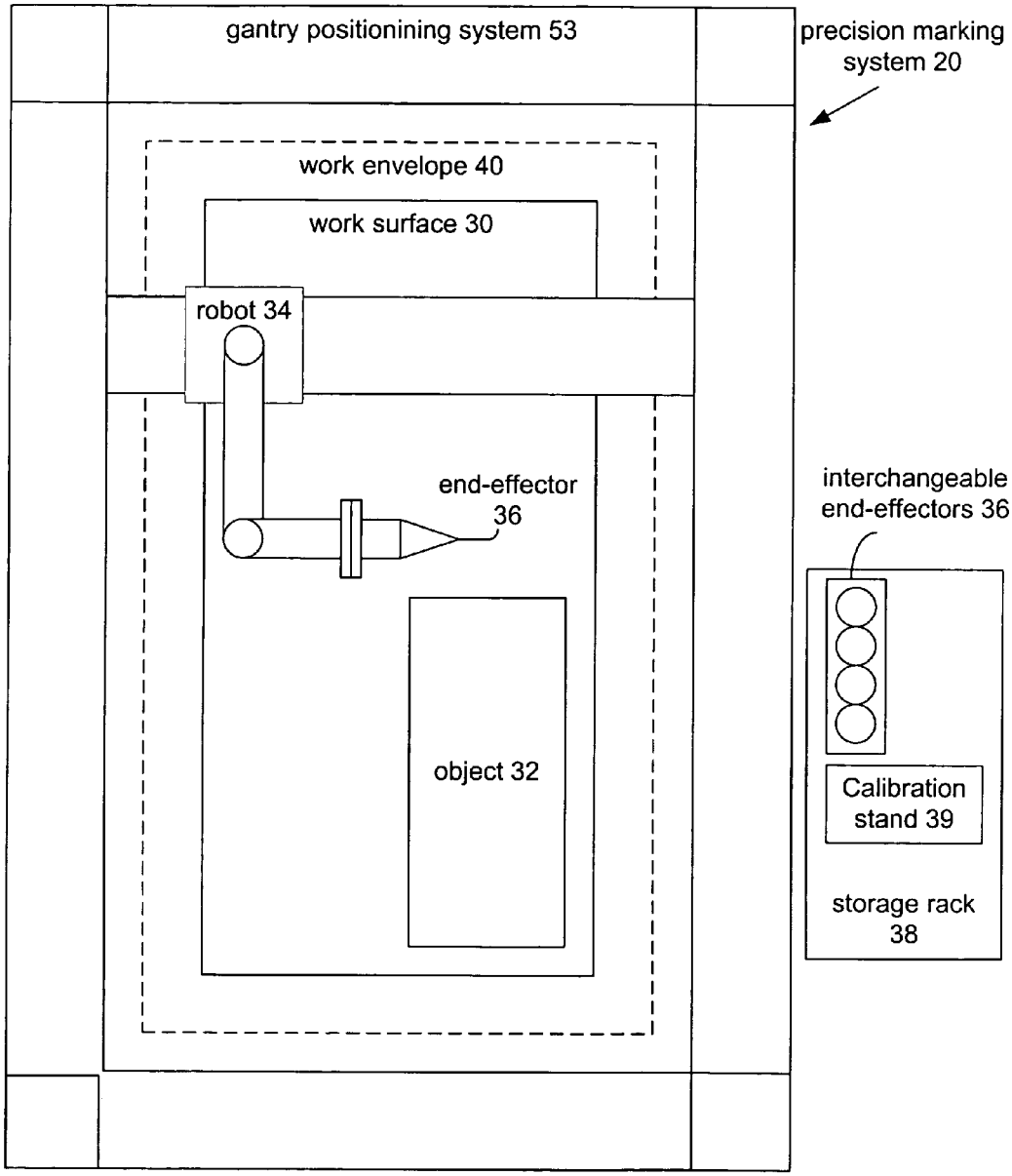
FIG. 4 provides a top-down view of one embodiment of a precision marking system in accordance with the present invention.

FIG. 3 provides a perspective view of one embodiment of a precision marking system 20 used to place reference markers on object 32 in accordance with the present invention. FIG. 4 provides a top-down view of one embodiment of a precision marking system 20 used to place reference markers on object 32. Object 32 may be a structure such as the understructure of an aircraft. Object 32 is placed on a work surface 30. Aircraft understructures or like objects require the locations for subsequent installation of various brackets, clips, grommets, etc. be precisely marked. The brackets and clips hold various equipment and utilities, where alignment of these pieces is critical. In one embodiment, objects are brought into the work envelop with Dual Platen Shuttle Tables. The work surface may use a vacuum system and a combination of pins and plugs to hold the objects rigidly on the table.

A robot 34 with multiple degrees of freedom and axes of rotation allows interchangeable end-effectors 36 to be positioned precisely relative to work surface 30 and object 32. As depicted, a fluid dispensing end-effector is shown coupled to robot 34. However, other end-effectors may be used to locate and perform other manufacturing processes. This marking end-effector facilitates the part marking process. One such end-effector is described in further detail within the description of FIG. 7. Although a gantry type robot is depicted, other robots with the necessary range and freedom of motion may be employed. Multiple interchangeable end-effectors 36 are maintained within storage rack 38. Calibration stand 39 allows the relative position of robot 34 and end-effector 36 to be calibrated every time it is picked up. Calibration of the marking head requires the system to mark a specific cross-hair pattern on a disposable media. The vision system images this pattern and calculates the actual locations of the markings relative to theoretical.

Figure 5:
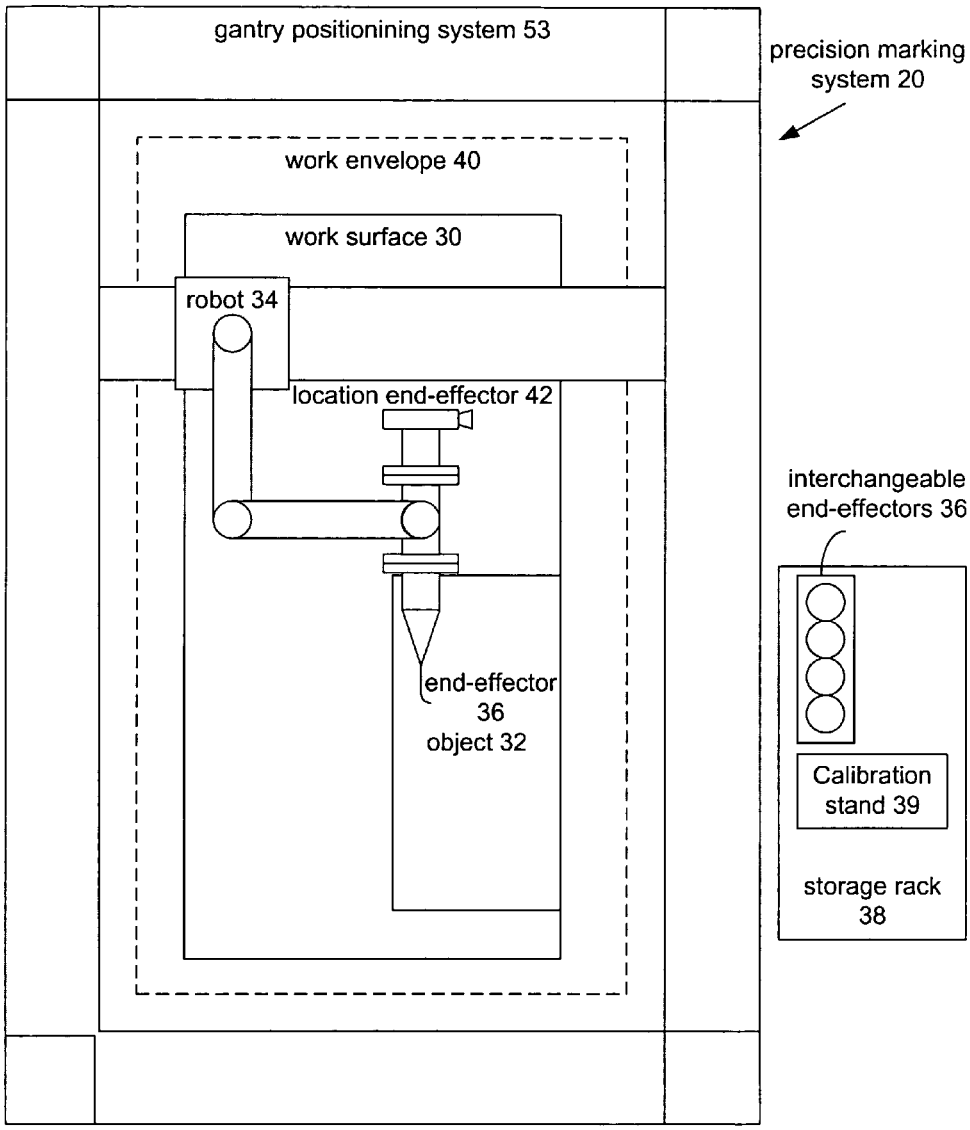
FIG. 5 provides a top-down view of a second embodiment of a precision marking system having a robot operably coupled to multiple end effectors.

FIG. 5 shows a second embodiment of the precision marking system 20 wherein multiple end-effectors 42 and 36 are coupled to robot 34. Location end-effector 42 may employ a vision system to accurately locate objects 32 within the work envelope 40. However, other comparable locations systems may be substituted for vision end-effector 42. Determining the accurate location of objects 32 within the work envelope 40 allows the relative position between object 32 and end-effectors 36 to be determined. After determining the relative location, marking end-effector 36 accurately applies ink or fluids to object 32.

One vision system includes a camera, lens and light ring, and laser line generator permanently mounted to the three-axis wrist 51 of robot 34 and is used to locate object 32 and its features. To locate the object, the vision system moves to a theoretical target location and images the actual location, then determines the X and Y coordinates of specific points or features on the object. An actual location is determined with a combination of imaged features. The elevation of the part is determined with a laser line projected at an angle onto the part. The camera picks up the location of this line and determines the height of the part by comparing where the line is in the image recorded by the camera and where the line is supposed to be based on the angle between the camera and the laser line generator. From these three inputs, a 6-degree part transformation is created by the control system coupled to the precision marking system 20.

In addition to locating targets and surfaces, the vision system can find edges of upstanding stiffeners, with the laser line projected across a stiffener and imaged by the camera. Analyzing the image reveals the left or right most end of the line, which represents the location of the desired edge of the stiffener. Images gathered may be used to create local transformations when required for extra precision.

Figure 6:
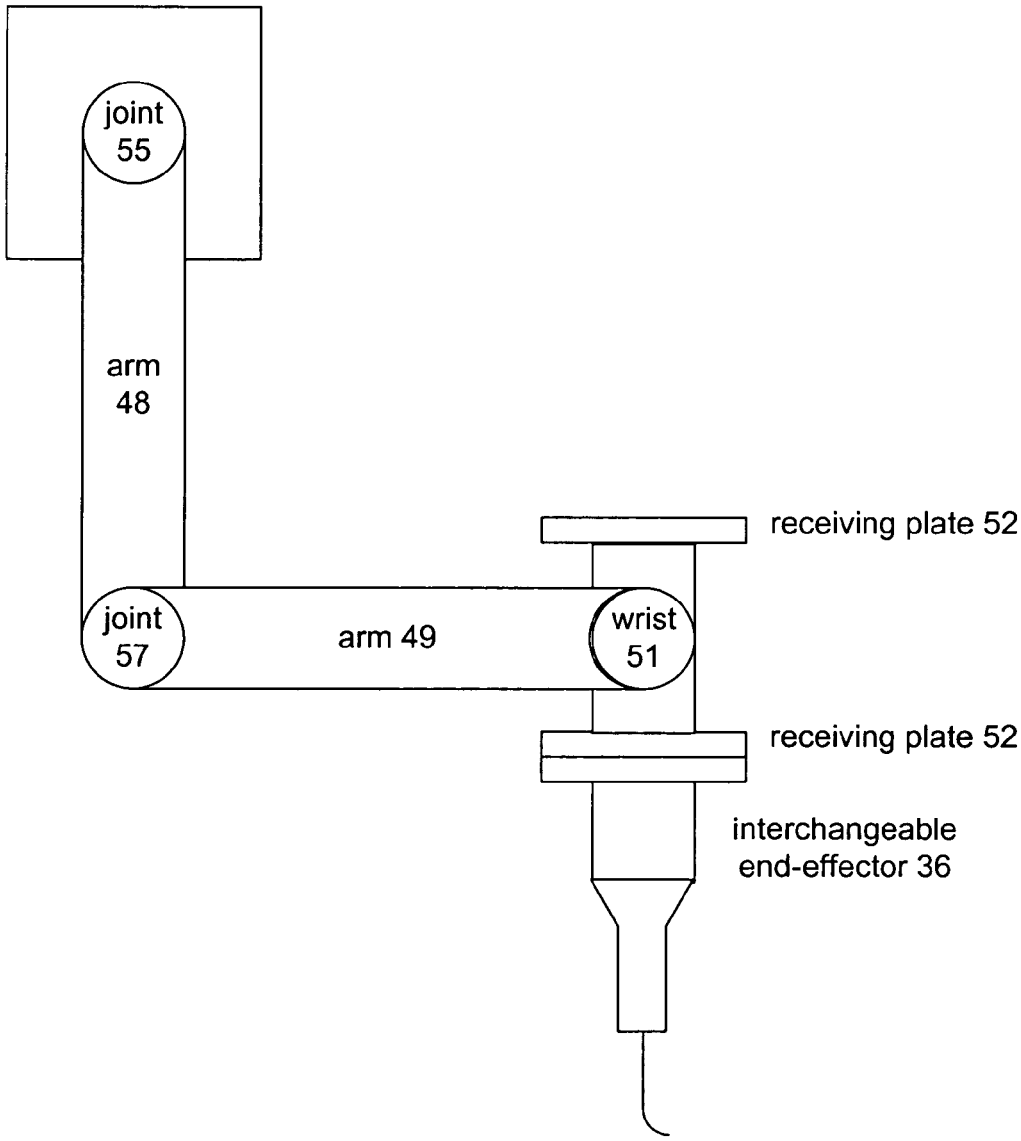
FIG. 6 depicts in further detail and scale the robot of FIGS. 3, 4 and 5.

FIG. 6 provides an enlarged view of Robot 34, which is coupled to gantry system 53 of FIGS. 3, 4 and 5. Here robot 34 comprises multiple arms segments 48 and 49 coupled together by joints 51 in order to allow robot 34 to reposition the interchangeable end-effector 36 within work envelope 40. Segments 48 and 49 are linked by joints 51, 55 and 57 to provide robot 34 the ability to position end-effector 36 at any point in the X, Y, and Z direction within 3-D work envelope 40. Additionally the ability of joints 51, 55 and 57 to rotate allows end-effector 36 to not only be positioned but rotated at any required angle relative to object 32.

Figure 7:
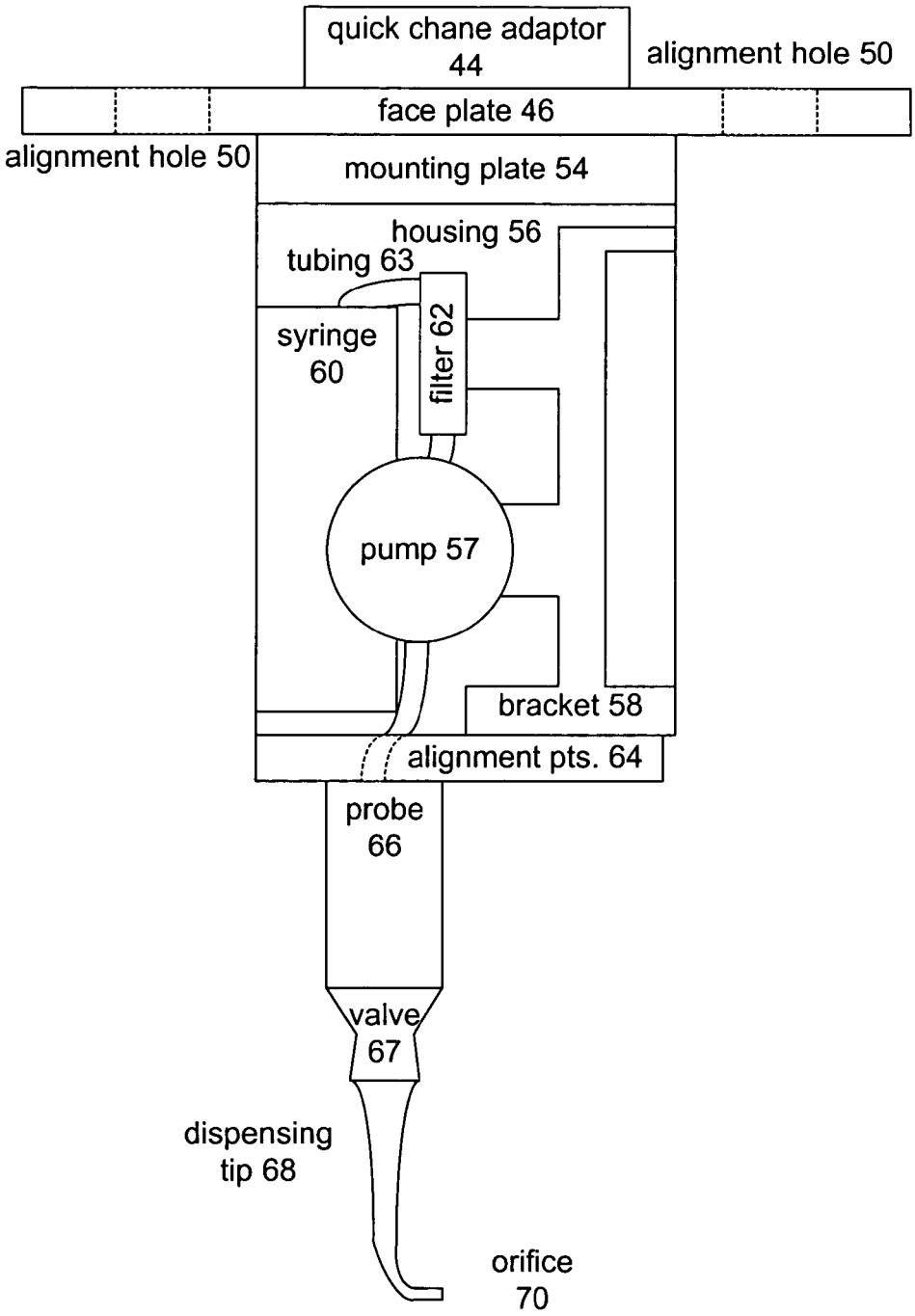
FIG. 7 depicts one embodiment of an end-effector to dispense fluid in accordance with the present invention.

FIG. 7 provides a more detailed view of fluid dispensing end-effector 36. End-effector 36 is an interchangeable end-effector having a quick-change adaptor 44, allowing the end-effector 36 to be interchangeably coupled to robot 34 via receiving plate 52 as depicted in FIG. 6. The quick-change adaptor prevents the end-effector from uncoupling from the robot in the event of air, vacuum, power, or other utility loss. Additionally, an integrated force-sensing, or multi-clutch mechanism may detect both moment and in-line axial forces to the probes themselves. This force sensor may include a Tactile Calibration Head integrated from off-the-shelf technology as known to those skilled in the art.

Faceplate 46 serves to secure and orient end-effector 36 to the receiving plate 52 of robot 34. To align end-effector 36, alignment features 50, such as holes and/or guide pins, align the end-effector to the receiving plate 52 of the robot. Umbilicals couple to end-effector 36 to provide power, hydraulics, fluids or other supplies to end-effector 36 via robot 34. Mounting plate 54 secures housing 56 that contains various components in the end-effector, to faceplate 46. These components include pump 57, mounting bracket 58, syringe or fluid reservoir 60, filter 62, and internal tubing 63. Alignments points 64 located at the bottom of housing 56 allowed the robot 34 to calibrate and precisely determine the position of the end-effector prior to each usage of the end-effector. Probe 66 receives filtered fluids drawn from reservoir 60 by pump 57 through internal tubing 63. High-speed pulse valve 67 allows this fluid to be precisely metered to dispensing tip's 68 stylus that ends in orifice 70. The low profile nature of dispensing tip 68 allows this end-effector to precisely mark parts or dispense fluids to geometrically confined spaces of objects that could not previously be marked with existing end-effectors. Orifice 70 angles away from dispensing tip 68 in FIG. 7 to facilitate dispensing fluids on a wall extending upwards from the surface (or floor) of object 32. In other embodiments, orifice 70 may be angled to facilitate the disposition of fluids on the floor rather than the wall.

An integrated collision detection system (such as force sensing, and/or multi-clutch mechanisms) prevents collisions between the object and the end-effector. Additionally, the dispensing tip is made from material with low coefficient of friction values, part marring in the event of a collision may be prevented. The weak-link failure location designed-in may cause the dispensing tip to snap in the event of catastrophic system failure.

Figure 8:
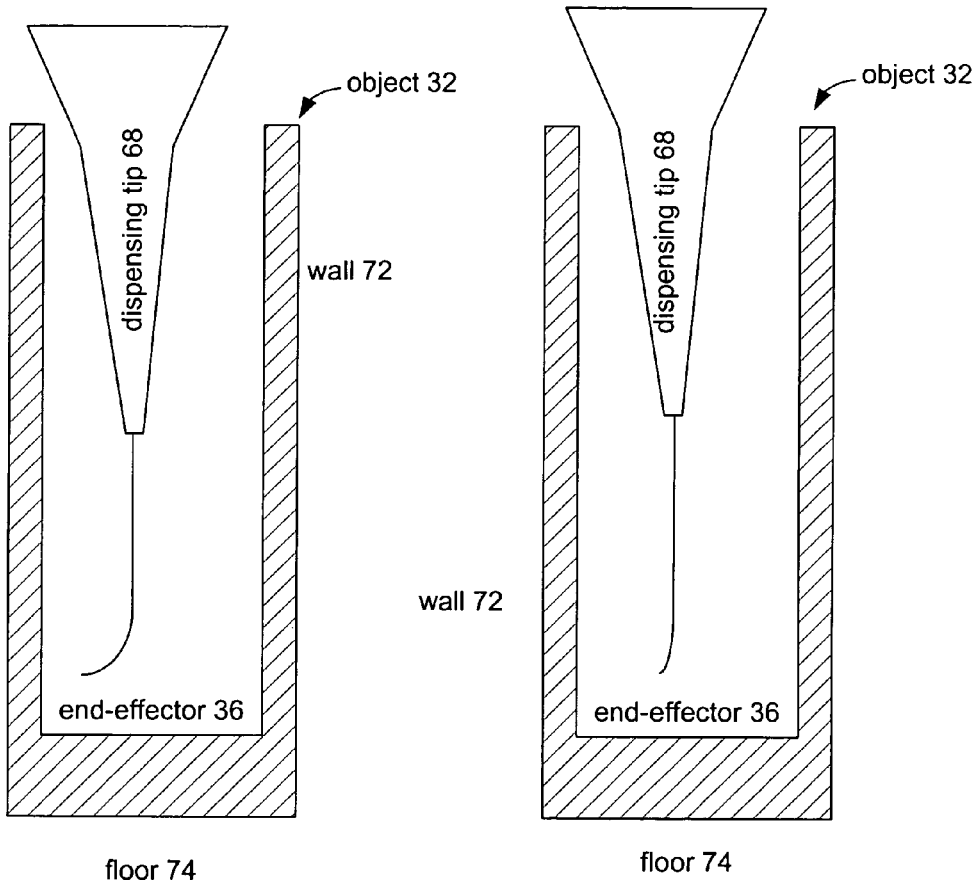
FIG. 8 depicts end-effectors that dispense fluids in geometrically constrained spaces.
Figure 9:
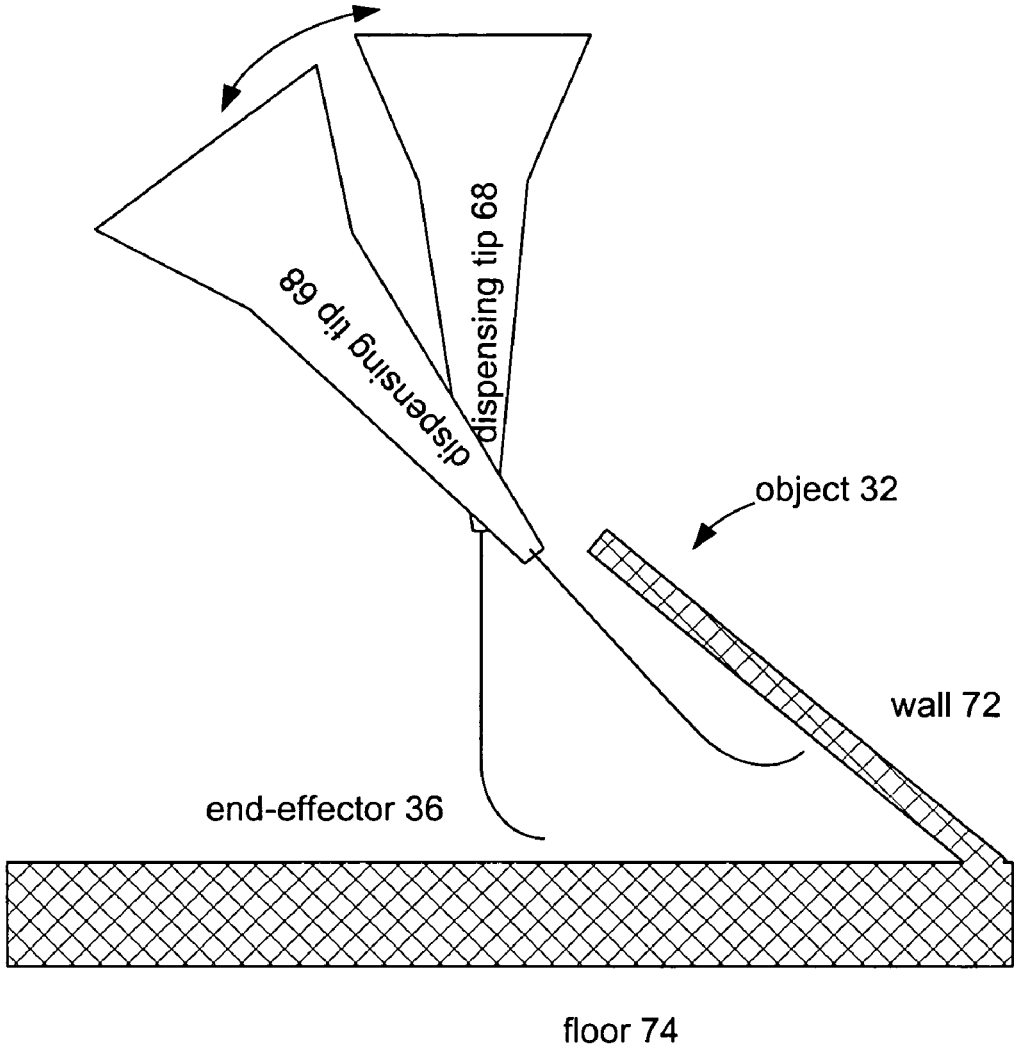
FIG. 9 depicts an end-effector operable to dispense fluids in a geometrically confined space with a surface at a non-normal angle to the surface of the part.

FIG. 8 depicts two embodiments wherein dispensing tip 68A has an orifice angled to deposit or dispense fluids on wall 72 of object 32 or on the floor 74 of object 32 with a dispending tip 68B. FIG. 9 illustrates that robot 34 may locate or position end-effector 36 at an angle such that dispensing probe tip 68 are better suited to dispense fluids on wall 72 when wall 72 is not located at an angle normal to the surface of object 32.

Figure 10:
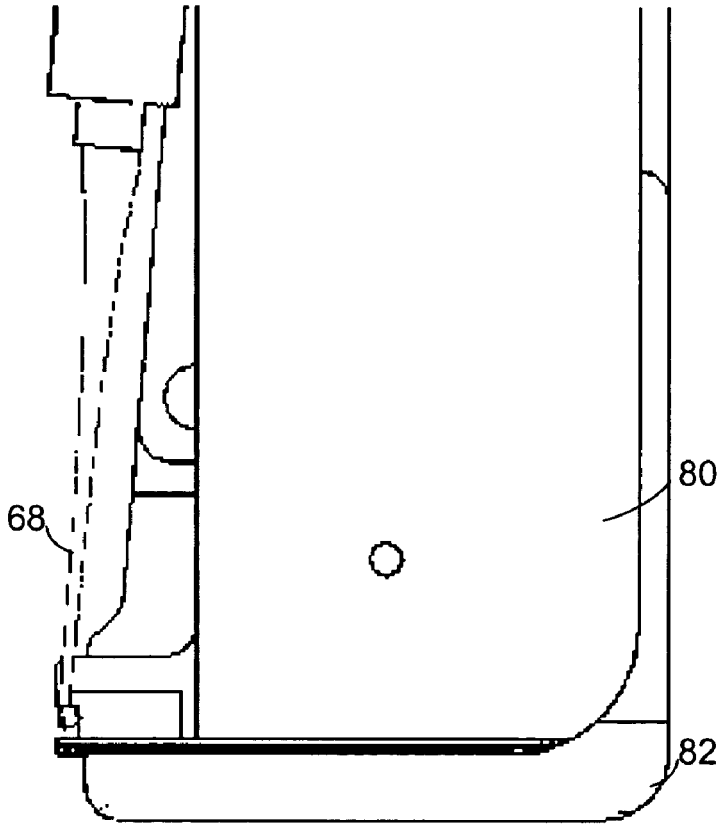
FIG. 10 provides a side profile view of a dispensing tip in accordance with the present invention as compared to existing marking or fluid dispensing heads.
Figure 11:
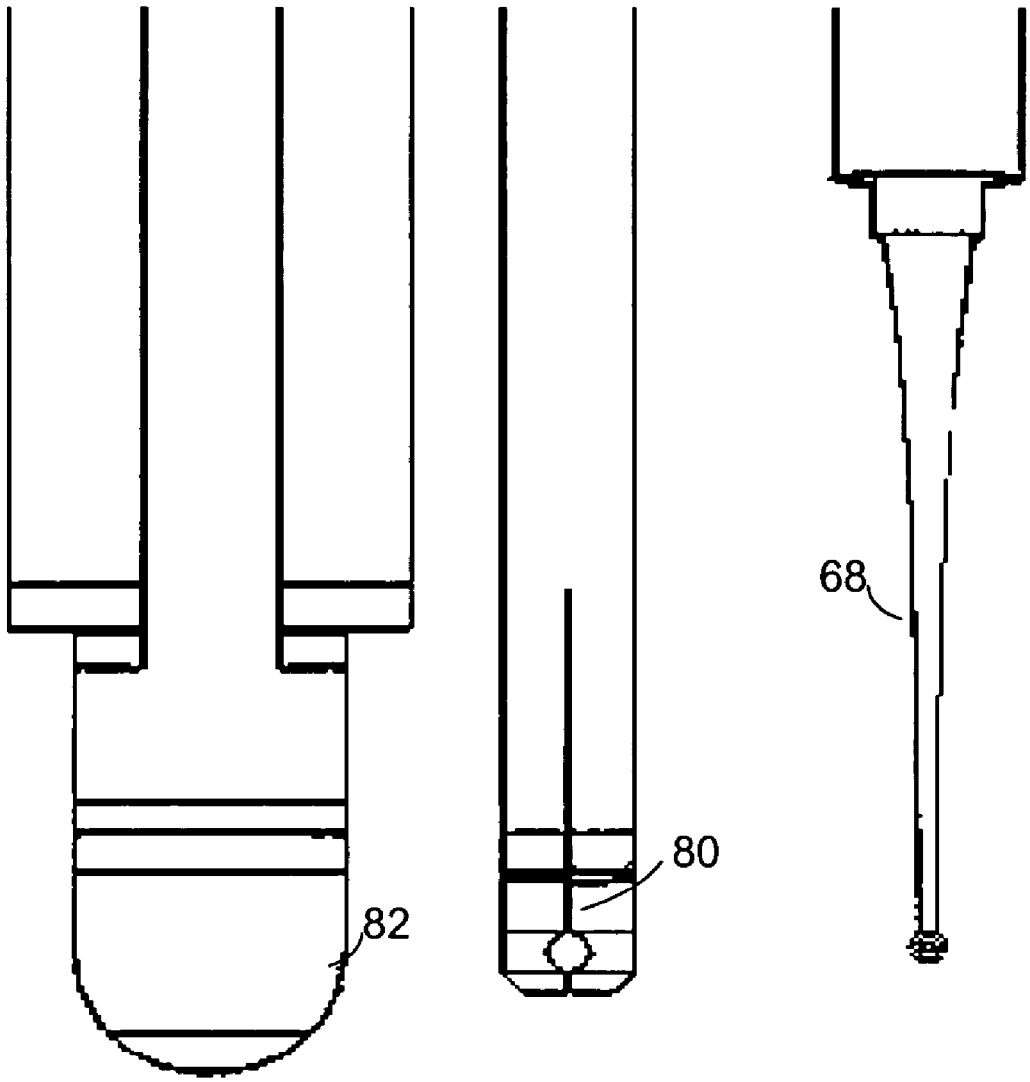
FIG. 11 provides a head on view of the dispensing tip of the present invention comparing the marking head and fluid dispensing system of currently available systems.
Figure 12:
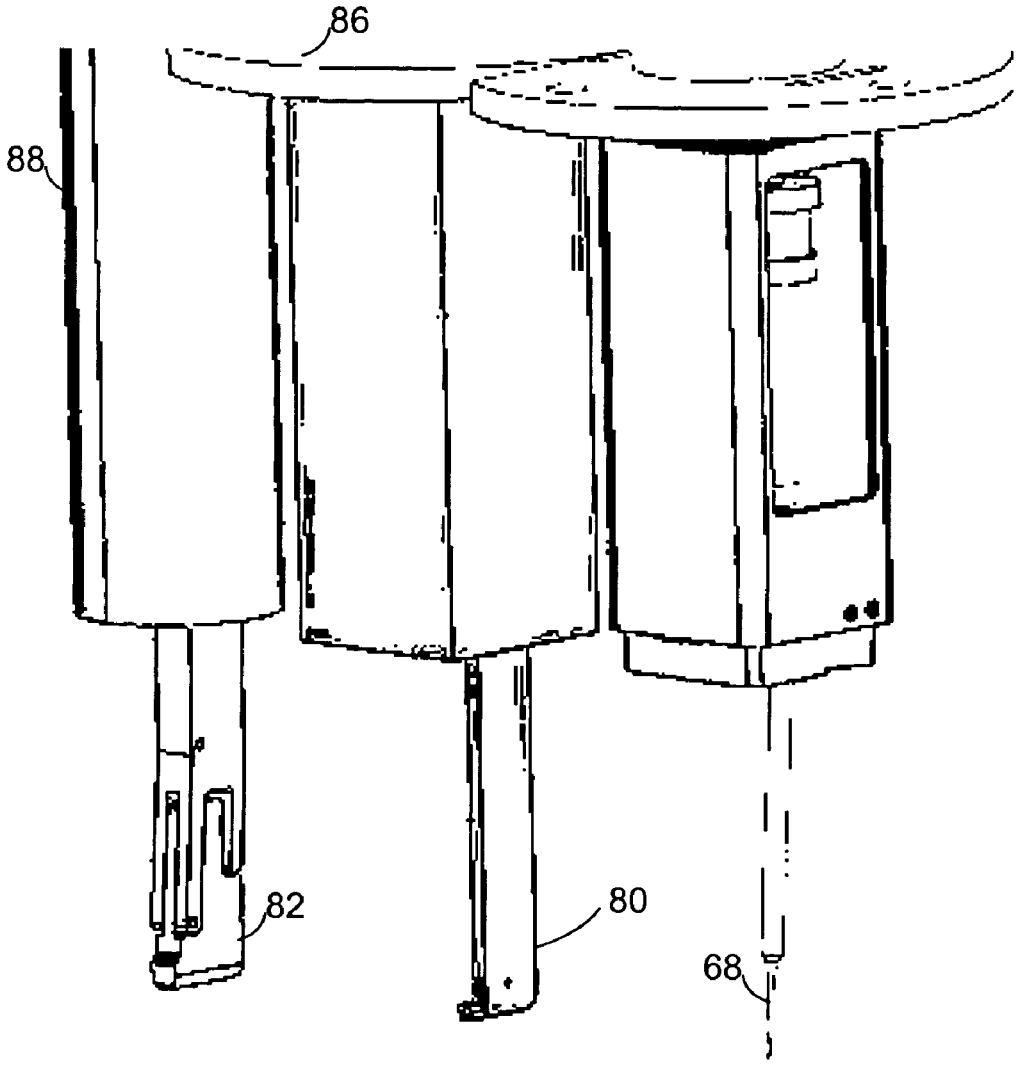
FIG. 12 provides a perspective view of one embodiment of an end effector in accordance with the present invention as compared to existing end-effectors used to dispense marking inks.

FIGS. 10, 11, and 12 compare the profile of dispensing tip 68 of the present invention to those of currently available fluid dispensing or ink jet systems. In FIG. 10, a side profile of dispensing tip 68 is compared to currently available ink jet marking head 80 and a prototype fluid dispensing system 82. FIG. 11 provides a front view of dispensing tip 68 as compared to ink jet marking head 80 and fluid dispensing system 82. FIG. 12 combines these views to provide prospective views of end-effector utilizing these different fluid-dispensing systems. Here, end-effector 36 on the right is compared to an ink jet marking head 86 having the ink jet applicator 80 of FIGS. 10 and 11, while end-effector 88 has fluid dispensing head 82 of FIGS. 10 and 11. These FIGUREs clearly evidence one advantage provided by the present invention wherein the dispensing tip increases access to geometrically confined areas.

Figure 2:
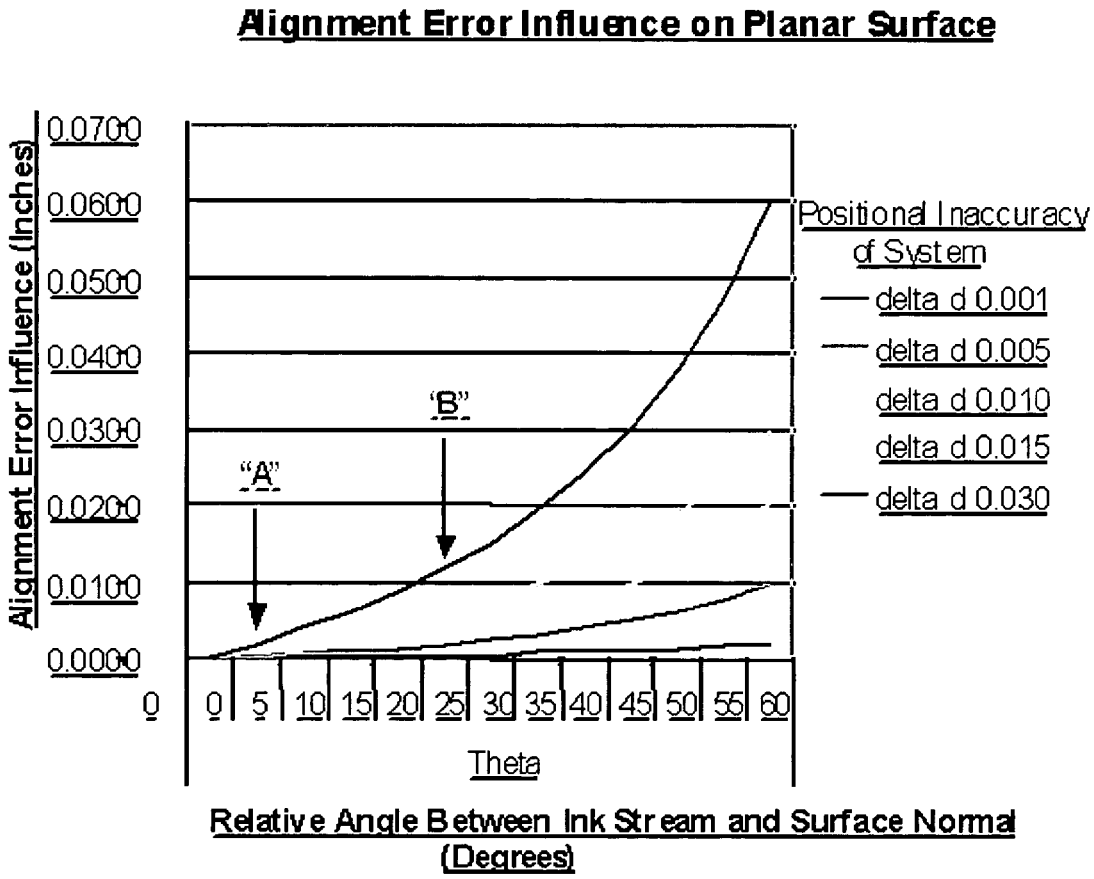
FIG. 2 is a graph depicting alignment errors associated with existing parts marking systems.
Figure 13:
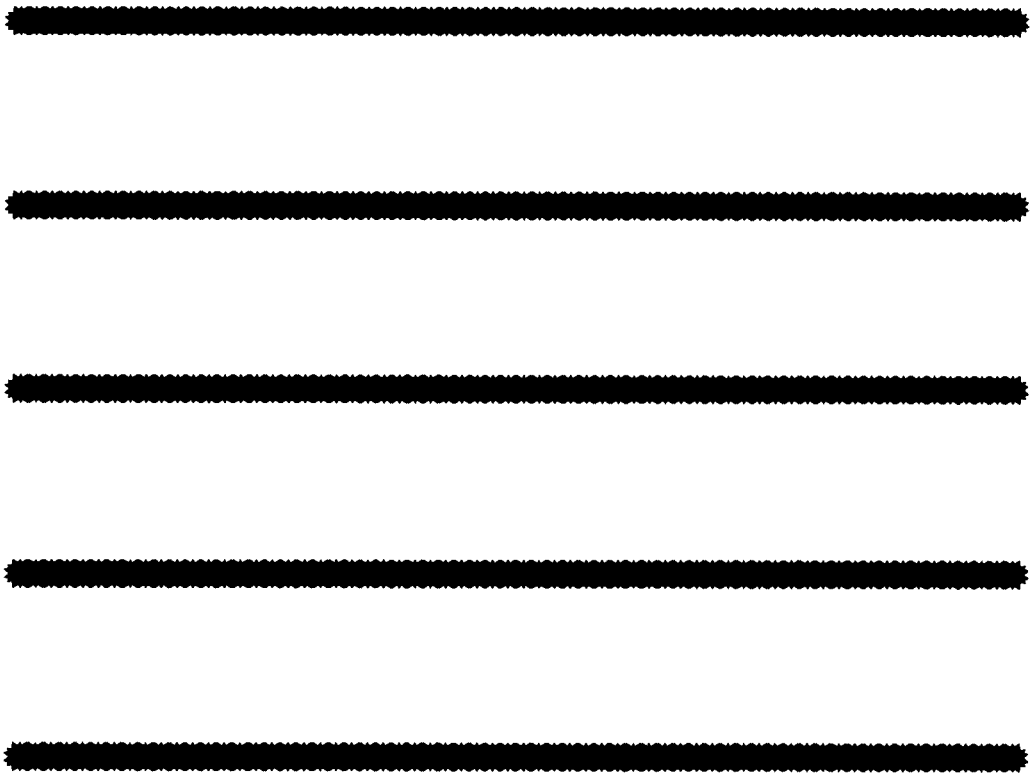
FIG. 13 depicts the poor resolution associated with current marking systems.
Figure 14:
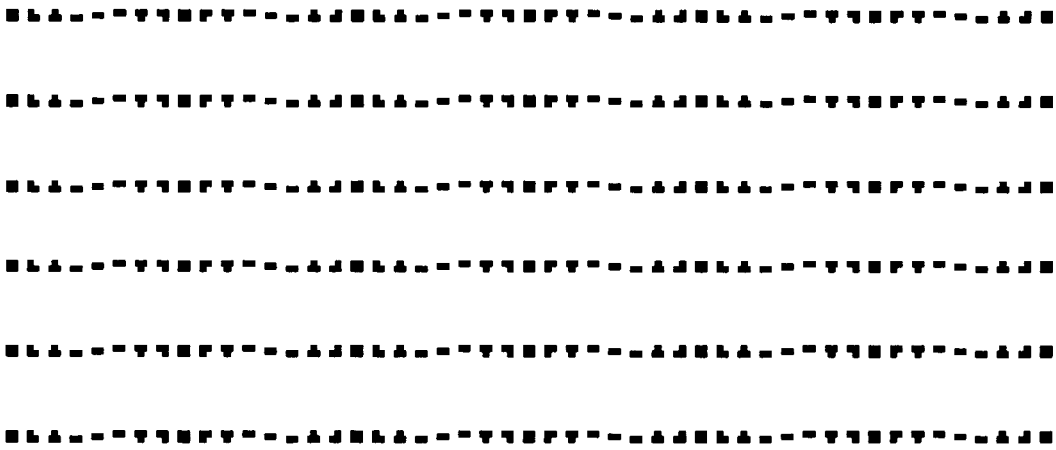
FIG. 14 illustrates the improved quality of markings available with the end effector provided in accordance with the present invention.
Figure 15:
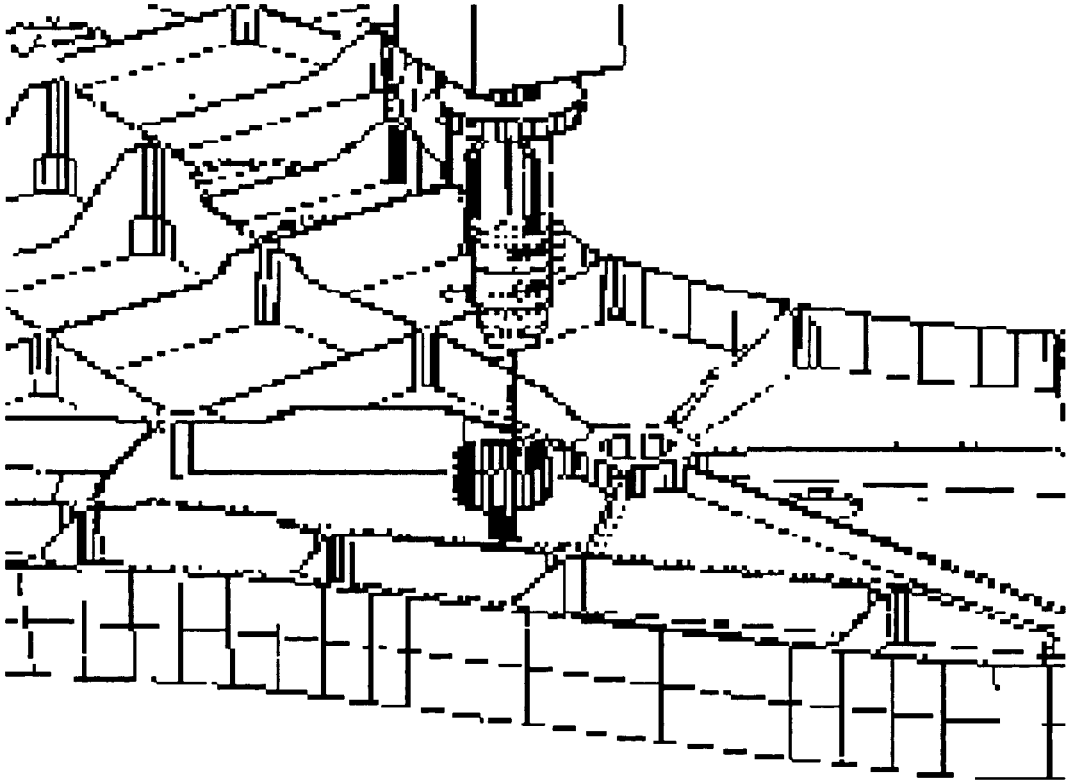
FIGS. 15 through 19 illustrate the various surfaces on which an end effector in accordance with the present invention may be used to dispense fluids or draw reference lines.
Figure 16:
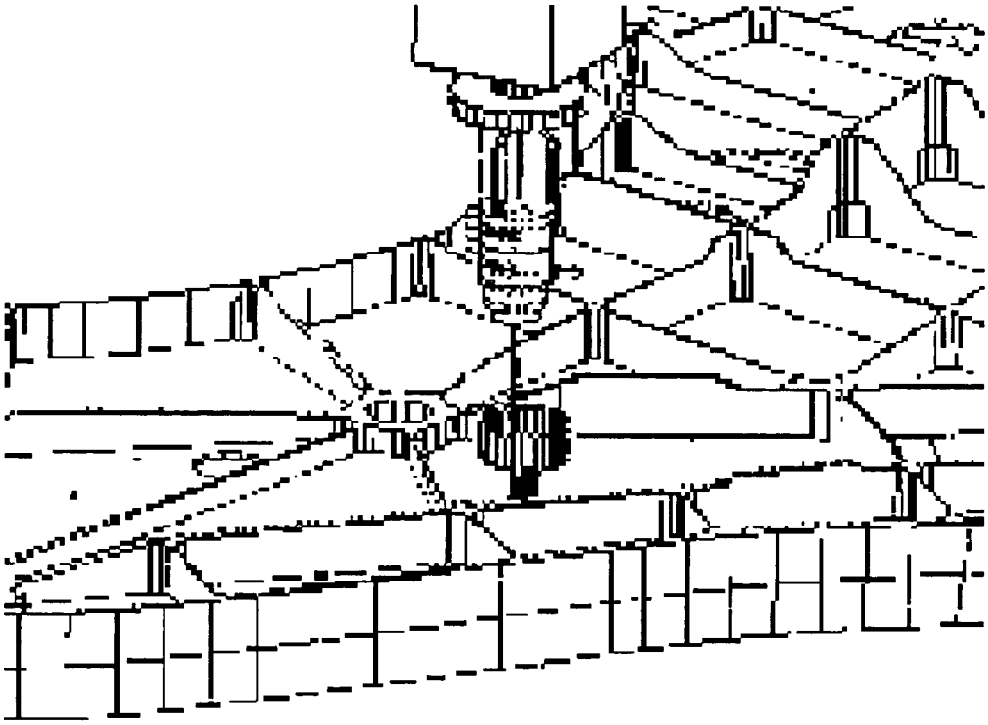
Figure 17:
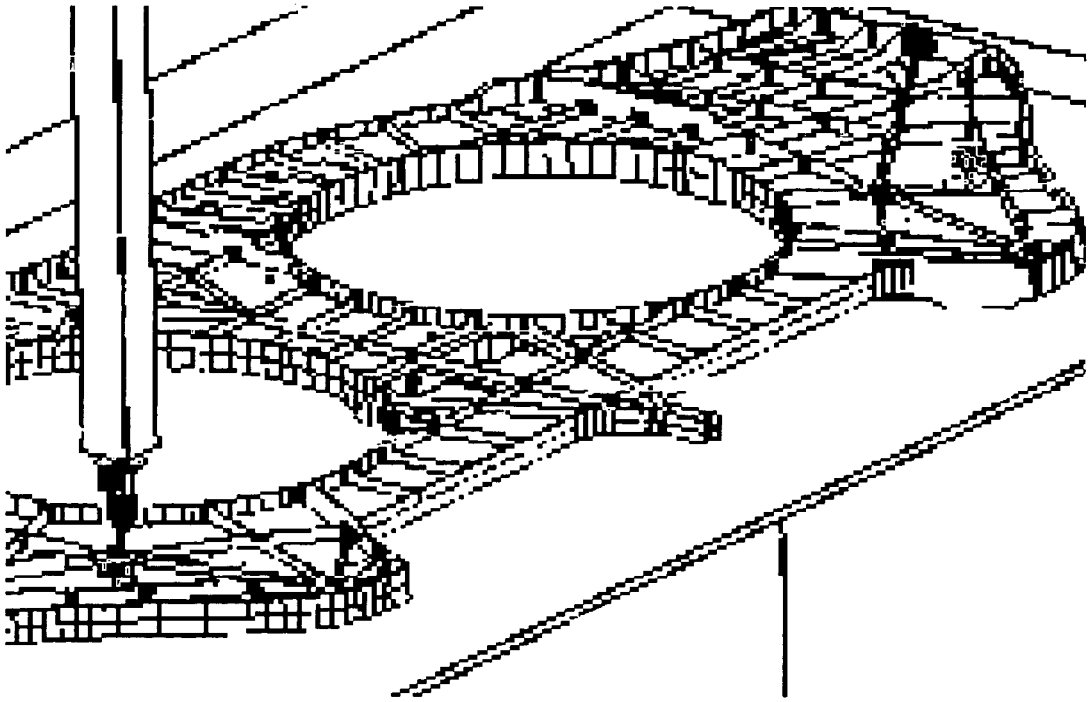
Figure 18:
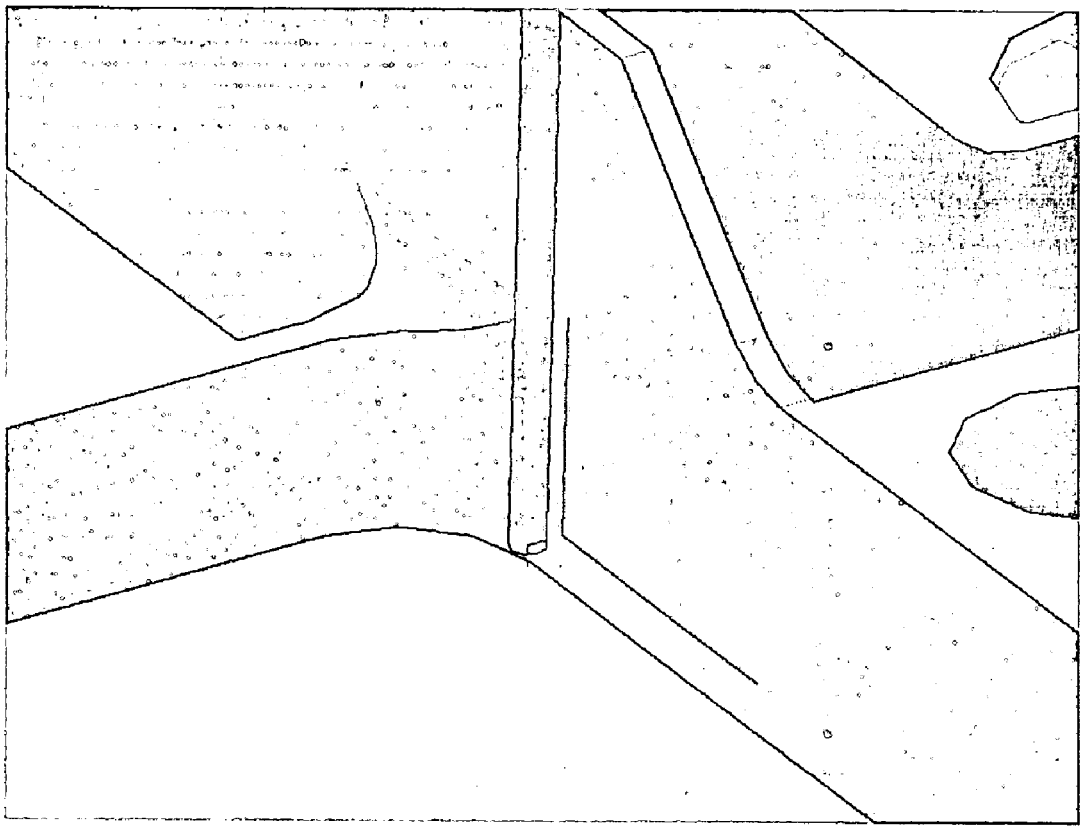
Figure 19:
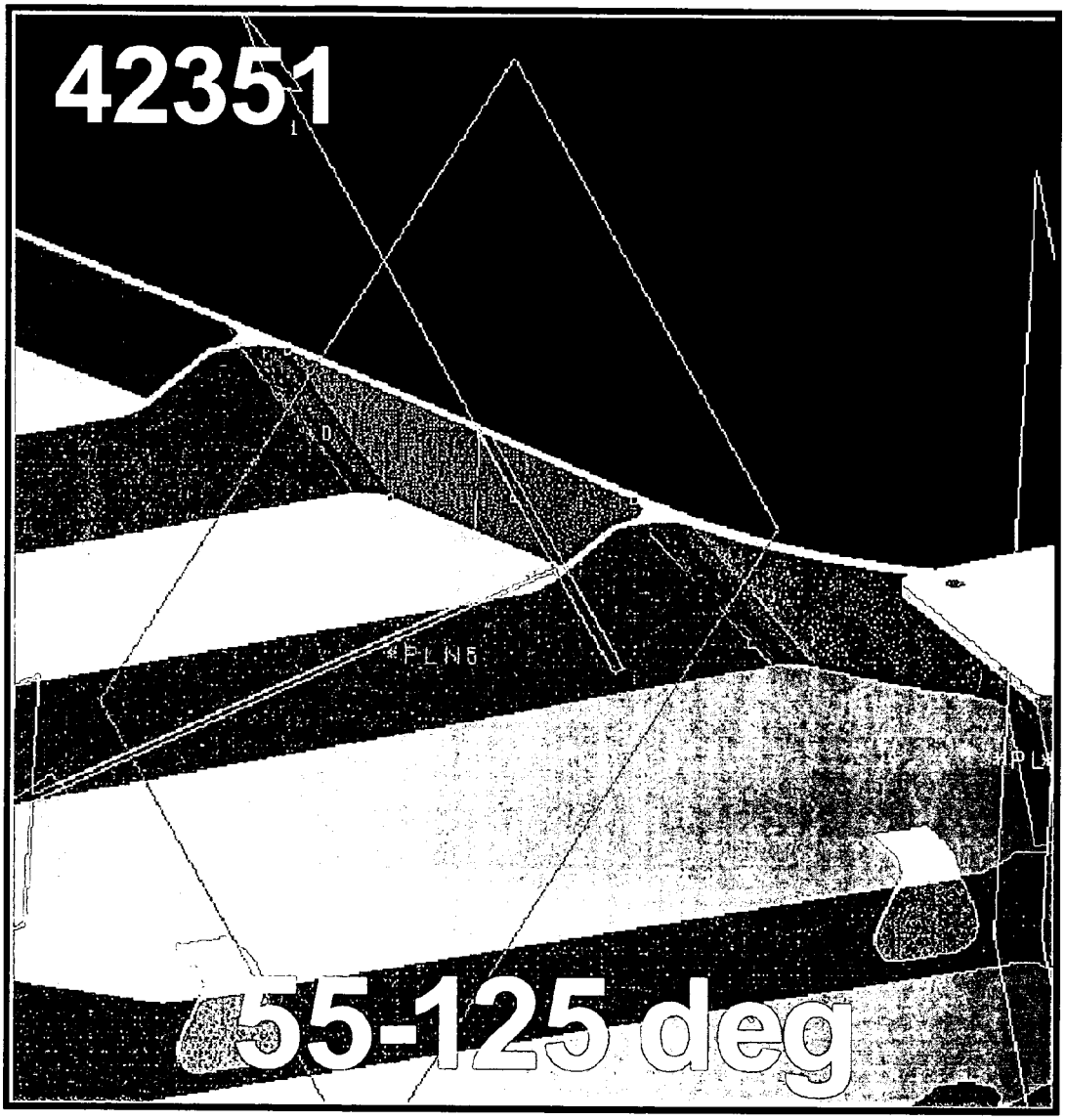

The present invention precision marking system and end-effector provided by reference or supporting documentation on an object allows marking lines to enable users to more quickly and accurately position subassemblies to the object. Furthermore, the present invention may be used to mark attached components to the object for further assembly or use. In addition, marking the object, subassemblies such as flanges stiffeners may be marked for additional subassemblies. FIGS. 13 and 14 depict the improved accuracy associated with dispensing tip 68 over prior marking systems. An example of reference lines using commercially available marking systems is depicted in FIG. 13. Lines do not provide the required accuracy to assemble components that demand. In comparison, more accurate reference markers exemplified by the markings of FIG. 14 facilitate meeting these tight requirements. The reduced profile of the dispensing tip help to reduce or eliminate alignment errors induced by the gap, between the fluid dispensing system and object to be marked. These inaccuracies originally described in FIG. 1 and FIG. 2, are reduced by insuring alignment to surface normal is maintained in all geometrically constrained areas.

Part marking system can reduce costs associated with assembling structural components, such as airframes by producing marks accurate enough for operators to locate parts and further machine the part (without expensive custom tooling). This invention helps to ensure that assembly tolerances are repeatably maintained. Custom tooling development, rework, and maintenance costs are greatly reduced by this marking system.

The automated part marking system can produce lines and curves on vertical, horizontal, angle, and contoured parts with exceptional precision. These lines visually locate assembly positions. Also, line-based symbols on vertical, horizontal, angled, and contoured part features with exceptional precision. These symbols may define the position of mounting holes, as well as communicate differences in their attachment procedures. Legible text written on surfaces helps identify the parts to be assembled in near-by locations, and provide other types of helpful work instructions.

In one embodiment, end-effector 36 can be repositioned by the system controller to follow part contour normals. There, particular attention is paid to the following performance parameters: (1) availability of end-effector to work cell, (2) accuracy of intended line marking, (3) producability of line marking in tight spaces, (4) robustness of operation including reliability, quality, and repeatability of part line mark; and interoperability consistency between copies of end-effectors, and (5) maintainability of operation including interchangeability/replacability of spare parts. This allows the end-effector to be manufactured maximize availability. Replaceable/consumable items (Pumps, Solenoids, Probes, Stylus, Jet Heads, Etc.) may be modular in nature to hasten repairs and improve maintainability.

The optimized line-marking accuracy, and repeatable with a reliable quick-change mechanism that maximizes repeatability of end-effector positional accuracy when coupled to the robot. A repeatable and reliable probe locating mechanism maximizes repeatability of the ink jet egress location(s) throughout end-effectors. Programmable lines may be produced by the end-effector as described by TABLE 1.

TABLE 1

| Line type(s) | straight & non-closing curves |
|---|---|
| Width(s) | Range 0.020–0.060 inches (Optimal values TBD via trials) |
| Length(s) | Range 0.5–7.0 inches typical |
| Formats | Solid and dashed |
| Color | various |

The geometrically constrained areas. In one embodiment, these restrictions are as follows: (1) Work volume restricted to 1.0×1.0×4.0 inch cube in axis X, Y, Z respectively; Work volume restricted @+/−100 degrees about tool centerpoint X; Work volume restricted @+/−100 degrees about tool centerpoint y; Work volume restricted @+/−360 degrees about tool centerpoint Z; Mark location all areas of interior walls. Representative Part Markings are Described in TABLE 2:

| Part Marking Communication Requirements and Symbology | | | | |
|---|---|---|---|---|
| | | Attachment Process | | |
| | | | Fastened pick-up Hole Alignment | |
| Assembled Object | Locating Features | Affected Area Bonded | Pick-up Hole Alignment (from pilot holes in other part) | Define Hole Alignment (for assembly of parts) |
| Bracket | Square Edges | 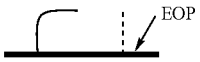  2 Adjacent.. Secondary = Dot:Dash | 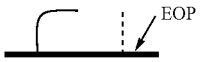  2 Adjacent.. Secondary = Dot:Dash | 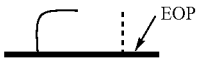  + |
| | Other | Same | Same | Cross-hairs only when reverse side marking req'd |
| Stud | Square Edges | N/A | N/A | N/A |

-continued

| Part Marking Communication Requirements and Symbology | | | | |
|---|---|---|---|---|
| | | Attachment Process | | |
| | | | Fastened pick-up Hole Alignment | |
| Assembled Object | Locating Features | Affected Area Bonded | Pick-up Hole Alignment (from pilot holes in other part) | Define Hole Alignment (for assembly of parts) |
| | Other | Extended Grid off footprint allows for Primer Removal | Not required. Holes in Stud will orient drill requirement | N/A |
| Grommet | Square Edges | EOP AS21265 | N/A | N/A |
| | Other | EOP Curved Line Following Bookends | N/A | N/A |
| Ilut Plate | Square Edges | N/A | N/A | N/A |
| | Other | N or N Extended Centerline for IIP-orientation with crosshair at hole center. | N or N Extended Centerline for IIP-orientation with crosshair at hole center. Drill rivet or fastener holes from pilots. | N/A |
| Clamp | Square Edges | N/A | N/A | N/A |
| | Other | N/A | N/A | Simple Cross-hair on hole center |

The text capability of the end-effector allows the end-effector to mark text with the following constraints in geometrically constrained areas. (1) Work volume restricted to 2.5×2.5×4.0 inch cube in axis X, Y, & Z respectively; (2) Work volume restricted @+/−60 degrees in about tool centerpoint X; (3) Work volume restricted @+/−60 degrees in about tool centerpoint y; (4) Work volume restricted @+/−360 degrees in about tool centerpoint Z; (5) Mark location—all bottom surface area of interior wall (when head is @ 0 Degrees in Axis X and Y); (6) Mark location—top 0.250 inch surface area of side walls (when head is rotated @ 60 degrees in Axis X or Y) with exceptions given to 0.250 inches @ corners; and (7) Mark tolerance—may be +/−0.200 inch in any direction within the defined envelope. The end-effector produces legible text of: various fonts such as Arial (Narrow font desired due to space constraints); Special Characters—Arrow that is proportionally sized and in-line with characters being produced; Font size(s)—6–12 pt; Font style(s)—Regular (Italics, Bold, & Bold Italics desired if sizing constraints permits); Font color(s)—One (black), (Red desired if sizing and cost constraints permits); Font length(s)—18 proportional characters within 2.5 inches.

(1) The Ink(s) selected for use in the end-effectors may be selected with ranked attention to: (1) optimization of mark accuracy, (2) optimization of mark quality, (3) ability to repeatably propel itself from ink jet head a specified distances (~0.100), (4) optimization of dry time, (5) maintainability characteristics of ink within Marking End-effectors, and (6) compliance with safety regulations. These inks selected for use in marking end-effectors may produce accurate and repeatable marks on paint-primed surfaces. The inks selected for use in marking end-effectors selected for use may cure to touch (not smudge) within about 30 seconds after mark is made. Additionally, these ink(s) may not require extensive maintenance provisions (routinely clog in any part of end-effector assembly). Cleansing procedures defined for routine maintenance and optimal performance of ink jet ports may involve solvents compliant with environmental requirements.

The present invention provides an end-effector to precisely mark location lines (or dispense fluids) on surfaces as part of an automated part marking system. The automated part marking system that includes a multi-axis gantry robot, a calibration stand, vision or location system(s), and a series of fluid dispensing (inkjet) end-effectors to accomplish the marking task. The end-effector use a pick shaped stylus coupled to a fluid supply and metered by a high-speed pulsed valve to precisely deliver fluids provides within geometrically confined spaces.

Improved accuracy is achieved by addressing five additive errors. An integrated calibration monument allows the multi-axis gantry robot to precisely determine the position of the tool centerpoint in space. This alignment is routinely performed. For example, this alignment may be performed as part of every marking process. This alignment may be applied to the vision or parts location system as well. By knowing the relative distance between the tool centerpoint and the parts location in space, the integrated system can accurately determine the parts position and alignment in space. This combined knowledge allows the end effector to accurately place the desired graphics on the part.

FIGS. 15 through 19 illustrate the various surfaces on which an end effector in accordance with the present invention may be used to dispense fluids or draw reference lines.

As one of average skill in the art will appreciate, the term "substantially" or "approximately", as may be used herein, provides an industry-accepted tolerance to its corresponding term. Such an industry-accepted tolerance ranges from less than one percent to twenty percent and corresponds to, but is not limited to, component values, integrated circuit process variations, temperature variations, rise and fall times, and/or thermal noise. As one of average skill in the art will further appreciate, the term "operably coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of average skill in the art will also appreciate, inferred coupling (i.e., where one element is coupled to another element by inference) includes direct and indirect coupling between two elements in the same manner as "operably coupled". As one of average skill in the art will further appreciate, the term "compares favorably", as may be used herein, indicates that a comparison between two or more elements, items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

Although the present invention is described in detail, it should be understood that various changes, substitutions and alterations can be made hereto without departing from the spirit and scope of the invention as described by the appended claims.

What is claimed is:

1. A precision marking system to place reference markers on an object that comprises:

a work surface on which the object is placed;

an object locator system to determine the location and orientation of the object and features within the object relative to the work surface;

a multiple axis robot, wherein positioning the multiple axis robot is directed by a control system; and at least one end-effector operable coupled to the multiple axis robot to place reference markers on the object, wherein the end-effector further comprises:

an ink delivery system;

a pulsed valve to regulate the supply of ink from the ink delivery system;

a curved stylus operable coupled to the pulsed valve to receive ink from the pulsed valve, and wherein the curved stylus has an internal orifice through which the ink is dispensed from the end-effector and onto the object.

2. The precision marking system of claim 1, wherein the ink delivery system further comprises an ink reservoir operably coupled to a positive displacement pump.

3. The precision marking system of claim 1, wherein the ink delivery system further comprises a positive pressure pneumatic reservoir delivery system.

4. The precision marking system of claim 1, wherein the curved stylus provide radial clearance around the orifice.

5. The precision marking system of claim 1, wherein the work surface comprises a shuttle table.

6. The precision marking system of claim 5, wherein the shuttle table further comprises a series of vacuum support pins in a predetermined arrangement for a given object.

7. The precision marking system of claim 1, wherein the object locator system further comprises a vision end-effector to locate the object within a work envelope.

8. The precision marking system of claim 1, wherein the multiple axis robot further comprises a 6-axis gantry robot.

9. The precision marking system of claim 1, wherein the reference markers provide alignment information for additional objects to be mechanically coupled to the object.

10. The precision marking system of claim 1, wherein the reference markers provide part identification information.

11. The precision marking system of claim 1, wherein the reference markers provide assembly information to a user.

12. The precision marking system of claim 1, wherein the object further comprises an aircraft under structure.

13. The precision marking system of claim 1, wherein the end-effector is oriented to place reference markers on the surface of the object.

14. The precision marking system of claim 1, wherein the end-effector is oriented to place reference markers on walls located at an angle to the surface of the object.

15. The precision marking system of claim 1, further comprises a calibration system operable to calibrate each end-effector when selected.

16. The precision marking system of claim 1, further comprising a storage rack operable to store the end-effector when the end-effector is not coupled to the multiple axis robot.

17. An end-effector to place reference markers on an object that comprises:

a fluid delivery system;

a pulsed valve to regulate the supply of fluids from the fluid delivery system; and a curved stylus operable coupled to the pulsed valve to receive fluids from the pulsed valve, and wherein the curved stylus has an internal orifice through which the fluids are dispensed from the end-effector and onto the object.

18. The end-effector of claim 17, wherein the fluid delivery system further comprises an ink reservoir operably coupled to a positive displacement pump.

19. The end-effector of claim 17, wherein the fluid delivery system further comprises a positive pressure pneumatic reservoir delivery system.

20. The end-effector of claim 17, wherein the curved stylus provide radial clearance around the orifice.

21. The end-effector of claim 17, wherein the end-effector isoperably coupled to a multi axis robot within a precision marking system.

22. The end-effector of claim 21, wherein the precision marking system further comprises:

a work surface on which the object is placed;

an object locator system to determine the location and orientation of the object and features within the object relative to the work surface; and the multiple axis robot, wherein positioning the multiple axis robot is directed by a control system.

23. The end-effector of claim 17, wherein the fluids further comprise inks, paints, epoxy, or adhesives.

* * * * *